United States Patent [19]

Hall

[11] Patent Number: 4,846,858

[45] Date of Patent: Jul. 11, 1989

[54] APPARATUS FOR EVAPORATING A LIQUID IN A GAS STREAM

[76] Inventor: S. Forrest Hall, 40 Chieftain Dr., St. Louis, Mo. 63146

[21] Appl. No.: 297,097

[22] Filed: Jan. 13, 1989

Related U.S. Application Data

[63] Continuation-in-part of Ser. No. 177,101, Apr. 4, 1988.

[51] Int. Cl.[4] ..... B01D 47/02

[52] U.S. Cl. ..... 55/240; 55/255; 55/257.2; 261/77; 261/78.1; 261/121.1

[58] Field of Search ..... 55/225, 255, 256, 240, 55/257.2, 257.3, 473; 261/121.1, 77, 78.1, 112

[56] References Cited

U.S. PATENT DOCUMENTS

| | | | |
|---|---|---|---|
| 3,285,712 | 11/1966 | Matasa et al. | 261/77 |
| 3,334,470 | 8/1967 | Huppke | 55/225 X |
| 3,675,396 | 7/1972 | Howryluk et al. | 55/225 |
| 3,790,141 | 2/1974 | Champeau | 261/77 |
| 3,985,518 | 10/1976 | Taylor | 55/225 X |
| 4,157,250 | 6/1979 | Regehr et al. | 55/257.3 X |
| 4,239,515 | 12/1980 | Yanagioka et al. | 261/77 X |

FOREIGN PATENT DOCUMENTS

| | | | |
|---|---|---|---|
| 0574128 | 12/1945 | United Kingdom | 55/225 |

*Primary Examiner*—Charles Hart

*Attorney, Agent, or Firm*—Senniger, Powers, Leavitt and Roedel

[57] ABSTRACT

An apparatus for evaporating a liquid in a gas. It comprises a mixing chamber, a fan for forcing the gas through the mixing chamber, a fluid intake for introducing liquid into the mixing chamber where it is evaporated in the gas, and an opening for discharging the gas and evaporated liquid from the mixing chamber. The mixing chamber comprises at least two sidewalls, constituting first and second sidewalls, diverging generally upwardly and a first slot between the bases of the sidewalls. Liquid is introduced into the mixing chamber against at least one of the sidewalls to flow downwardly thereon to adjacent the slot. The gas is forced generally upwardly through the slot and into the mixing chamber in a stream to atomize the liquid adjacent the slot and propel it upwardly with at least a portion of the atomized liquid being evaporated in the gas stream. The divergence of the sidewalls decreases the velocity of the stream before it is discharged from the chamber to cause unevaporated liquid to fall out of the stream.

17 Claims, 4 Drawing Sheets

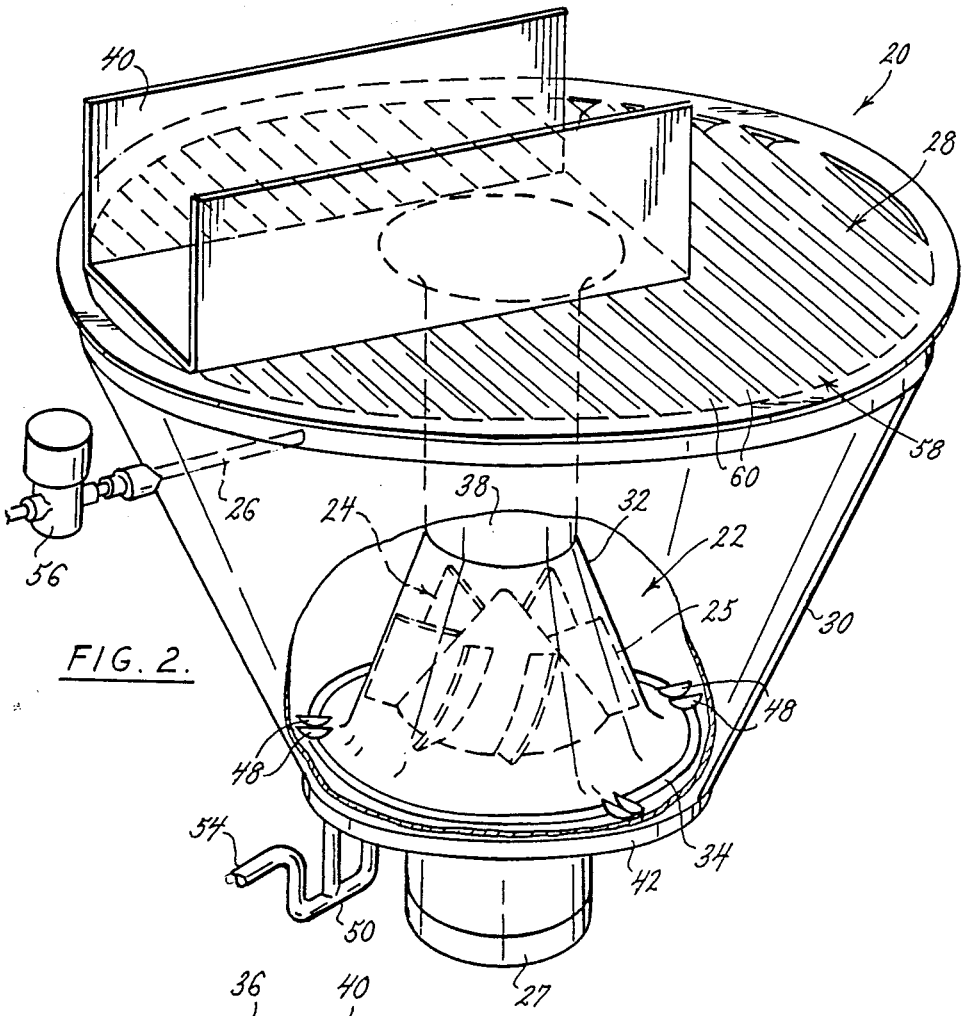
FIG. 2.
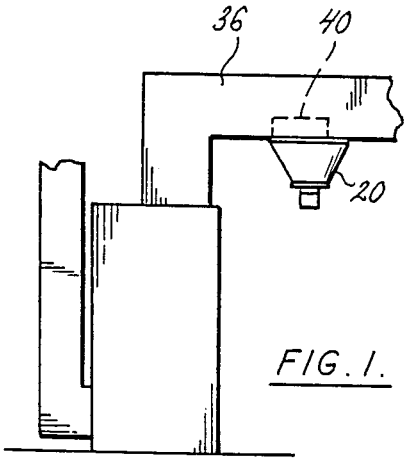
FIG. 1.
FIG. 5.
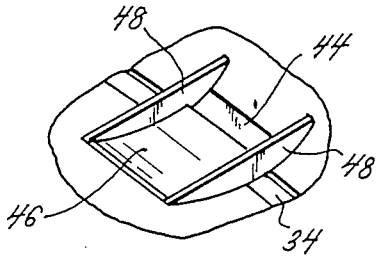

FIG. 10.
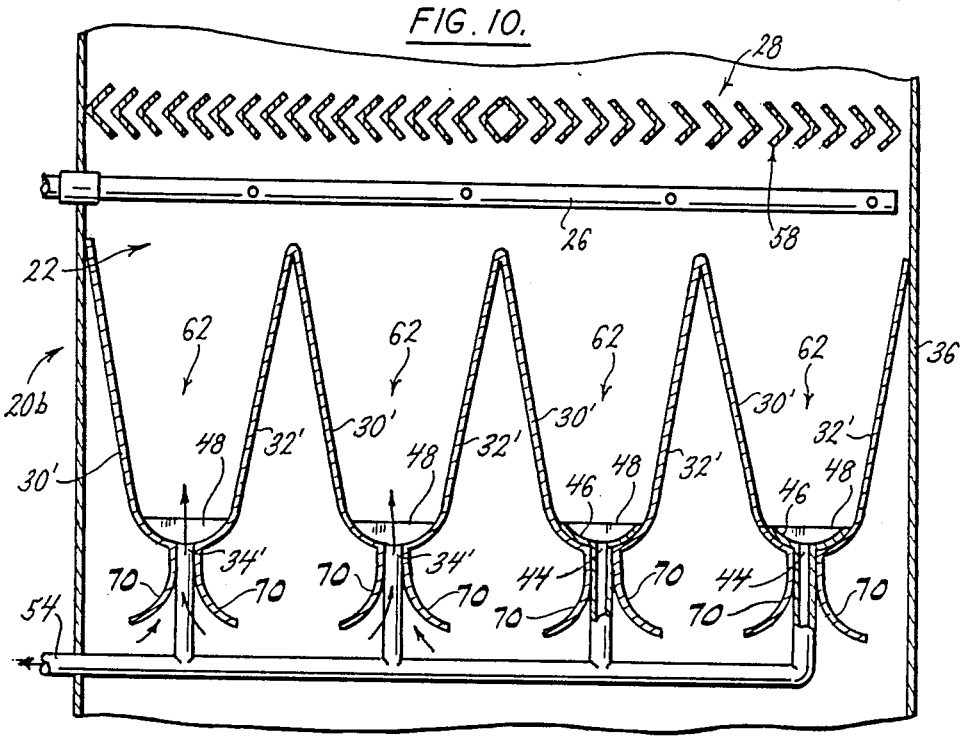
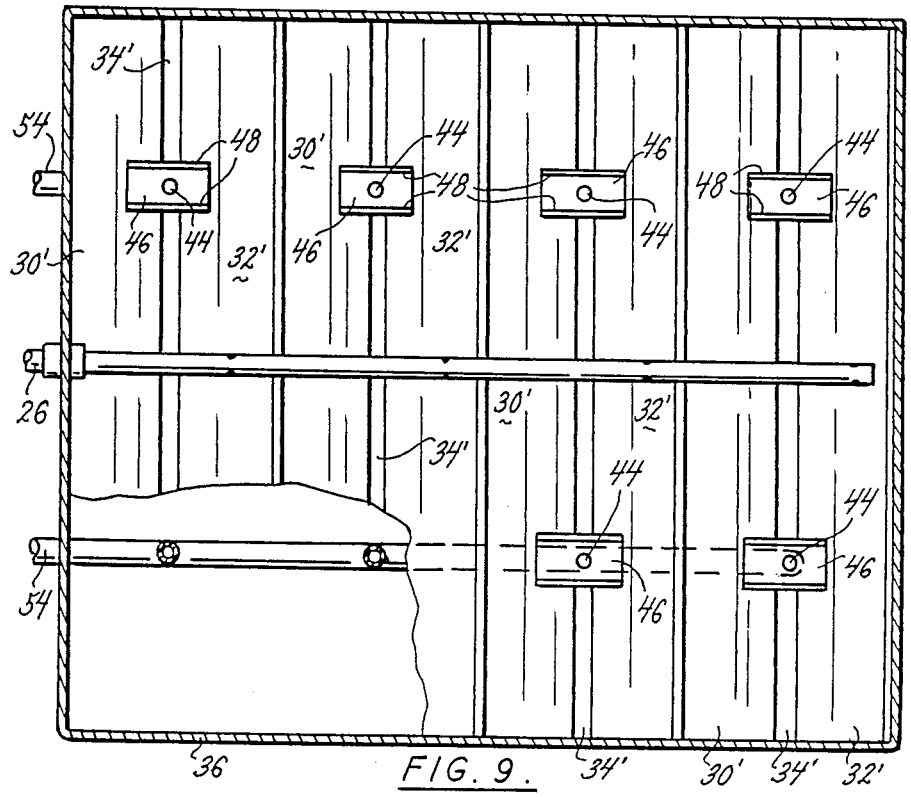
FIG. 9.

APPARATUS FOR EVAPORATING A LIQUID IN A GAS STREAM

CROSS-REFERENCE TO RELATED APPLICATION

This application is a continuation-in-part of copending application, Ser. No. 177,101, filed Apr. 4, 1988.

BACKGROUND OF THE INVENTION

This invention relates generally to an apparatus for evaporating a liquid in a gas stream.

Various types of evaporative devices, for example humidifiers and cooling towers, are known which evaporate a liquid such as water in a gas stream such as air. In one type of evaporative device nozzles are employed to spray water into an air stream where the water is evaporated. In another type of device, water is sprayed onto a porous material through which air is blown to evaporate the water. A disadvantage of these devices is that the nozzles and/or porous material tend to clog with impurities from the water. When clogged, water does not readily pass through the nozzles and air does not readily pass through the porous material. Thus, the nozzles and porous material lose their effectiveness and must be serviced frequently to clean or replace the clogged elements. This servicing increases the operating cost of the devices and also increases "down time" when the devices are not operating.

SUMMARY OF THE INVENTION

Among the objects of the present invention may be noted the provision of an apparatus for evaporating a liquid in a gas stream; the provision of such an apparatus that atomizes a liquid and introduces it into a gas stream where it is evaporated; the provision of such an apparatus that is resistant to being clogged by impurities in the liquid; the provision of such an apparatus that requires a minimum of service and maintenance; the provision of such an apparatus that is of relatively simple and inexpensive construction.

The apparatus of the present invention is adapted for evaporating a liquid in a gas. Generally, this apparatus comprises a mixing chamber, means for forcing the gas through the mixing chamber, means for introducing liquid into the mixing chamber where it is evaporated in the gas, and an opening for discharging the gas and evaporated liquid from the mixing chamber. The mixing chamber comprises at least two sidewalls, constituting first and second sidewalls, diverging generally upwardly, and a first slot between the bases of the sidewalls. Liquid is introduced into the mixing chamber against at least one of the sidewalls to flow downwardly thereon to adjacent the slot. Gas is forced generally upwardly through the slot and into the mixing chamber in a stream to atomize the liquid adjacent the slot and propel it upwardly with at least a portion of the atomized liquid being evaporated into the gas stream. The divergence of the sidewalls decreases the velocity of the stream before it is discharged from the mixing chamber to cause unevaporated liquid to fall out of the stream.

In the apparatus of the present invention, the gas stream passing through liquid adjacent the slot atomizes the liquid, eliminating the need for spray nozzles that are subject to clogging. Additionally, since the liquid is atomized by the force of the gas stream, there is no need for nozzles or porous material, which can clog with impurities, to effectuate evaporation of the liquid into the gas. Thus, servicing and maintenance are reduced. Finally, the apparatus is of relatively simple and inexpensive construction, and reliable operation.

These and other advantages will be in part apparent and in part point out hereinafter.

BRIEF DESCRIPTION OF THE DRAWINGS

FIG. 1 is a side elevation view of a first embodiment of an apparatus constructed according to the principles of the present invention shown as it would be connected to a duct of a ventilation system for use as a humidifier.

FIG. 2 is a perspective view of the apparatus of the first embodiment;

FIG. 5 is an enlarged perspective view of the overflow drain in the first embodiment;

FIG. 9 is an enlarged cross-sectional plan view taken along line 9-9 of the third embodiment showing the elongate slots; and FIG. 10 is a cross-sectional elevation view of the apparatus of the third embodiment.

Corresponding reference numerals indicate corresponding parts throughout the several views of the drawings.

DETAILED DESCRIPTION OF PREFERRED EMBODIMENTS

Figures 3, 4:
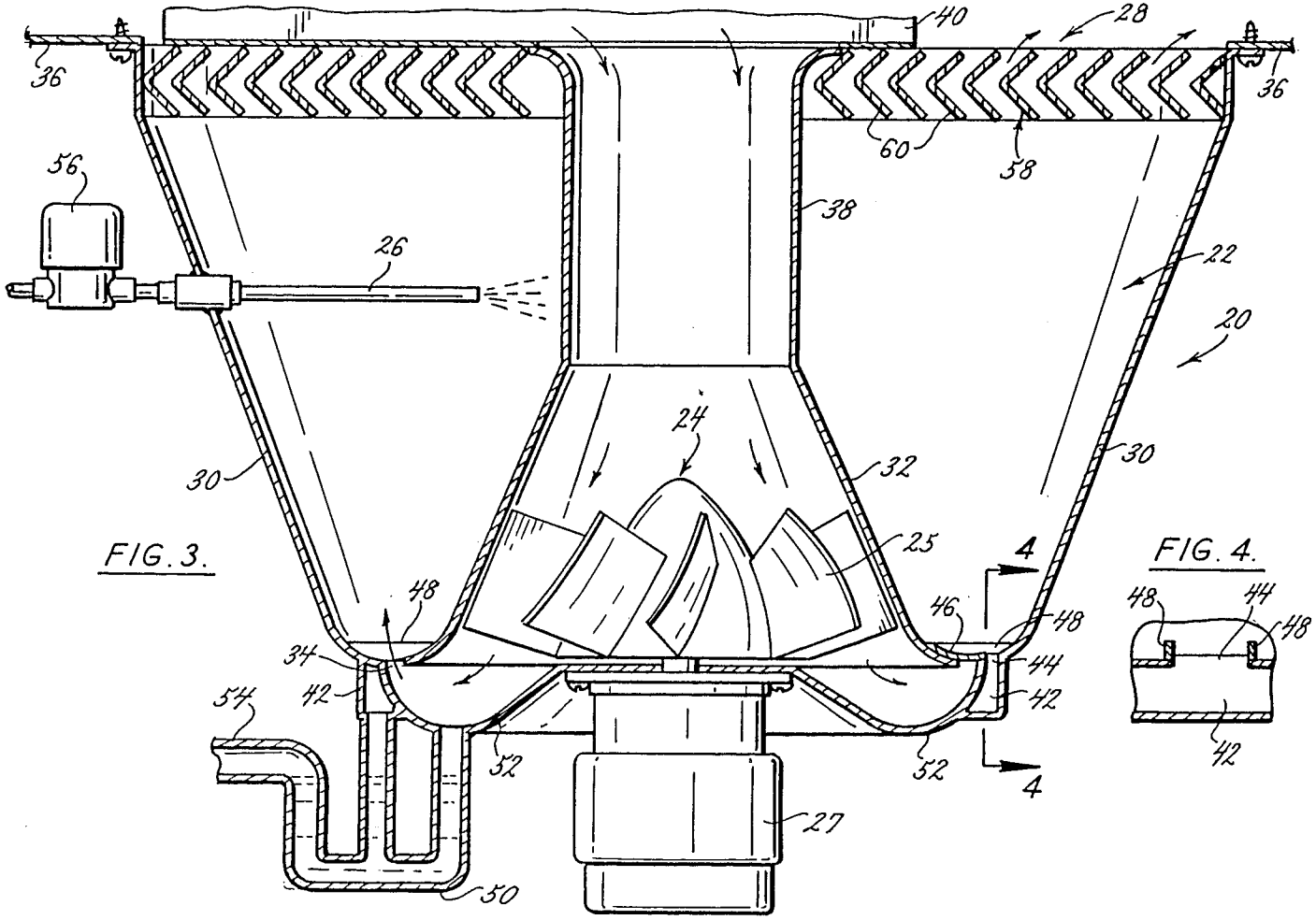
FIG. 3 is an enlarged cross-sectional view of the apparatus of the first embodiment.
FIG. 4 is a partial cross-sectional view of the first embodiment taken along line 4—4 of FIG. 3 showing the overflow drain in the first embodiment.

A humidifier apparatus, for evaporating water into air, constructed according to the principles of this invention is indicated generally as 20 in FIGS. 1-3. While the preferred embodiments described herein relate to humidifier devices for evaporating water into air, the invention is not so limited, and may be used to evaporate any liquid into any gas. The apparatus 20 comprises a mixing chamber 22, a fan 24 constituting means for forcing gas through mixing chamber 22, a tube 26 constituting means for introducing water into mixing chamber 22 where it is evaporated in the gas, and an opening 28 for discharging the gas and evaporated liquid from mixing chamber 22. Mixing chamber 22 comprises first and second sidewalls 30 and 32 diverging generally upwardly and an annular slot 34 disposed between the bases of sidewalls 30 and 32. Water flowing through the tube 26 is introduced into mixing chamber 22 against at least one of the sidewalls to flow downwardly thereon to adajacent slot 34. Fan 24 forces air generally upwardly through slot 34 and into mixing chamber 22 in a stream to atomize the water adjacent the slot and propel it upwardly with at least a portion of the atomized water being evaporated in the air stream. The divergence of sidewalls 30 and 32 decreases the velocity of the stream before it is discharged from chamber 22 to cause unevaporated water to fall out of the stream.

As shown in FIGS. 1 and 3, apparatus 20 may be connected to a duct 36 of an HVAC system. Dry air from duct 36 is drawn, by fan 24, through an intake tube 38 and forced through slot 34. Fan 24 comprises a rotor 25 and electric motor 27, both well known in the art. Fan 24 also forces the air and evaporated water from chamber 22 out through opening 28 and into duct 36. A baffle 40 is positioned over a portion of opening 28 to prevent the discharged air and evaporated water from being sucked through intake tube 38 and recirculated through apparatus 20. Thus, only dry air is drawn from duct 36. Although intake tube 38 and sidewall 32 are shown as being two adjacent elements, they could be formed as one element with the inner surface of the element defining tube 38 and the outer surface of the element defining sidewall 32.

First sidewall 30 is funnel-shaped and extends upwardly and outwardly with respect to slot 34. Second sidewall 32 has a generally frusto-conical shape tapering upwardly with respect to slot 34 and is concentric with and disposed radially inwardly of slot 34. The divergence of sidewalls 30 and 32 causes the velocity of the stream to decrease as the stream rises within chamber 22. The sloping of sidewalls 30 and 32 also causes water to cascade downwardly toward slot 34 at a relatively high speed. The high speed of the cascading water overcomes the resistance exerted by the air stream and, therefore, allows the water to pass over slot 34 where it can be atomized by the force of the air stream. The bases of sidewalls 30 and 32 are curved and slot 34 is narrow so that the cascading water flows transversely over slot 34 rather than through slot 34. The force of the air stream and the transverse flow of the water keeps the water from falling through the slot. Preferably, sidewalls 30 and 32 are coated with or made of a non-wetable material, such as Teflon® or the like, for reducing friction, for preventing impurities from clinging to sidewalls 30 and 32, and for facilitating cleaning.

Apparatus 20 further includes an annular channel 42, positioned generally below slot 34, and a plurality of drain openings 44, through the base of sidewall 30. Excess water, adjacent slot 34, which may build up if the rate of delivery exceeds the rate of evaporation, is drained through openings 44 and into channel 42. Openings 44 and channel 42 prevent excess water from accmulating adjacent to and blocking slot 34. Impurities in the water which remain after evaporation are also washed through openings 44. Small covers 46 are positioned over slot 34 to block air from flowing out the slot 34 adjacent the openings 44 because air blowing over openings 44 might interfere with drainage. Plates 48, positioned on opposite sides of each opening 44 and transversing slot 34, direct excess water into opening 44. A drain trap 50 communicates with channel 42 for draining water from channel 42. Trap 50 also communicates with an annular pan 52, which forms part of the passageway for air forced through the slot 34, to drain any water which flows through slot 34. The drained water then flows out drain pipe 54. If the drained water has a low concentration of impurities, it could be recirculated through tube 26 and reintroduced into chamber 22. A valve 56 is connected to tube 26 to control the flow rate of water introduced into chamber 22 and to, thereby, minimize the amount of excess water adjacent slot 34.

A grid 58 of L-shaped baffles 60 is positioned generally above sidewalls 30 and 32 extending across opening 28 to capture unevaporated water from the gas stream. The captured water drips from grid 58 to sidewalls 30 and 32 and then flows downwardly toward slot 34. Although gid 58 is shown as comprising L-shaped baffles 60, it is to be understood that other shapes and other constructions could be implemented.

In operation, water pours out the tube 26 and cascades down sidewalls 30 and 32 toward the slot 34. The cascading water collides into the side of the upwardly directed air stream being forced through the slot 34 by fan 24. The collision with the air stream atomizes the water and projects it upwardly with the stream. As the atomized water travels upwardly with the stream at least some of the atomized water is evaporated in the stream. As the atomized water and air stream rise, their velocity decreases because of the increasing volume of the mixing chamber (resulting from the divergence of the side walls). Because of the decrease in velocity, most of the unevaporated water falls out of the stream and falls onto sidewalls 30 and 32 where it again cascades downwardly toward slot 34 to be atomized by the air stream. The decrease in velocity also increases the time the atomized water is in the chamber and, therefore increases the amount of water evaporated. The unevaporated water which does not fall out of the stream with a decrease in velocity passes through grate 58 and is captured thereby. The captured water drips from grate 58 and falls back onto sidewalls 30 and 32. The evaporated water and air stream pass through opening 28 and are mixed with the dry air flowing through duct 36. Thus, apparatus 20 evaporates water in an air stream and discharges humidified air into the duct of an HVAC system. Since air, rather than water, is forced through slot 34, no deposits form on slot 34 to impede flow. Thus, apparatus 20 requires little service or maintenance for cleaning and/or replacing elements. Also, apparatus 20 is of simple and inexpensive construction, and reliable operation.

Figure 7:
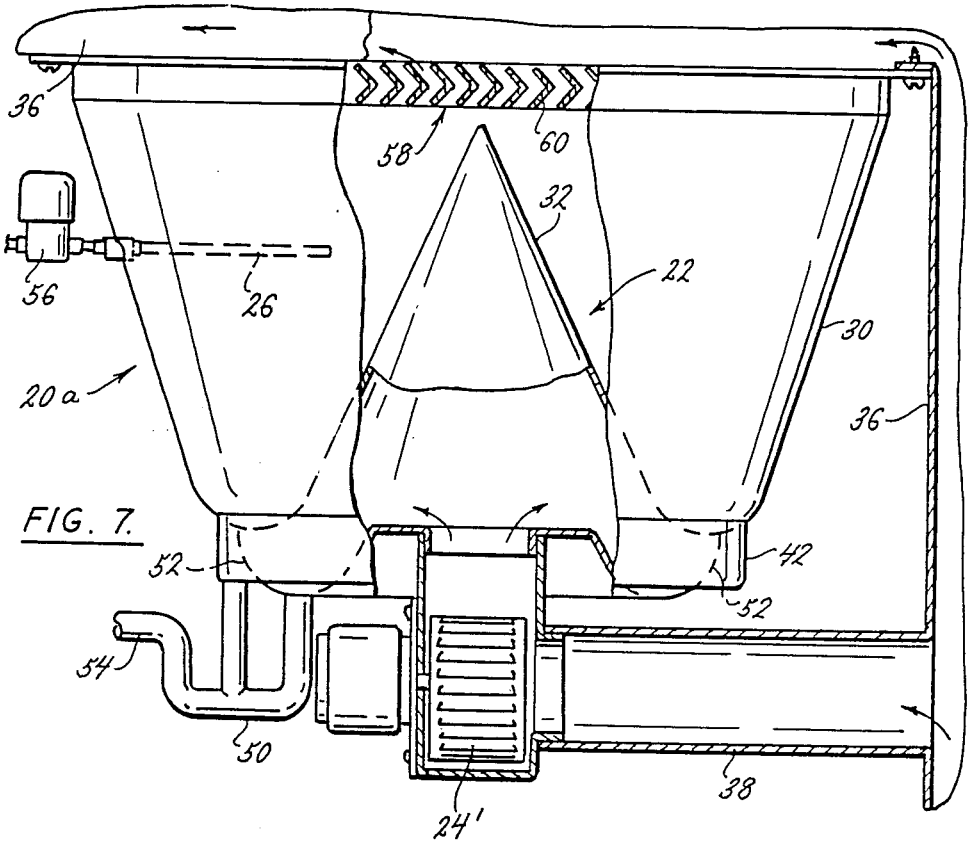
FIG. 7 is an enlarged side elevation view of the apparatus of the second embodiment with portions broken away.
Figure 6:
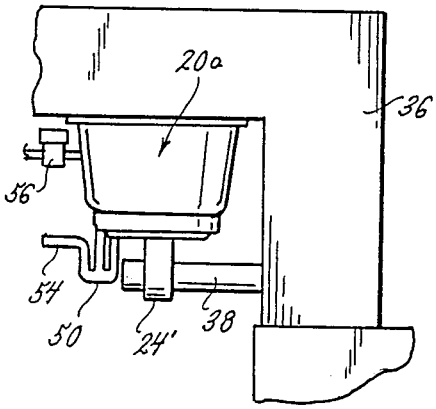
FIG. 6 is a side elevation view of a second embodiment of an apparatus constructed according to the principles of the present invention, shown as it would be connected to a duct of a ventilation system.

In a second preferred embodiment, constructed according to the principles of the present invention shown as a humidifier connected to a duct and indicated generally at **20*a*, is shown in FIGS. 6 and 7. In apparatus 20*a*, dry air is drawn upstream from a vertical portion of duct 36 and humid air is discharged downstream to a horizontal portion of duct 36. Apparatus 20*a* is similar in several respects to apparatus 20. For convenience corresponding parts are numbered identically as those parts shown in FIGS. 1–5. Instead of the fan 24 in device 20, device 20*a* uses a squirrel-cage type fan 24' which draws air in through intake tube 38 and forces it through the slots and into chamber 22**.

Figure 8:
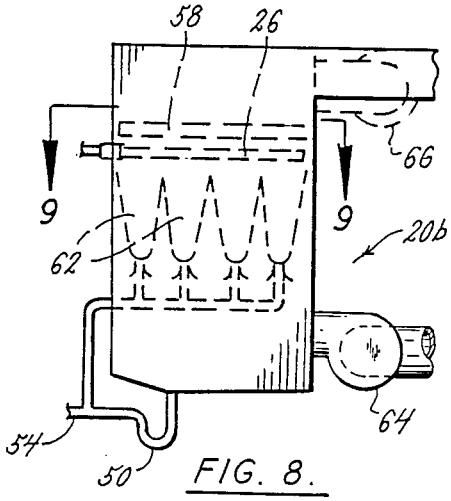
FIG. 8 is a side elevation view of a third embodiment of an apparatus constructed according to the principles of the present invention having a plurality of elongate slots through which gas is forced.

A third embodiment, shown as a humidifier apparatus **20*b* connected to a duct of an HVAC system, is shown in FIGS. 8–10. In apparatus 20*b* the mixing chamber 22 comprises a plurality of side-by-side subchambers 62. Apparatus 20*b* is similar in construction to apparatus 20. Thus, for convenience the corresponding parts are numbered identically as those parts shown in FIGS. 1–5. Subchambers 62 are defined by sidewalls 30' and 32' diverging generally upwardly from generally parallel elongate slots 34'. Air is forced through slots 34' by fan 64. Converging vanes 70 adjacent slots 34' direct the air through slots 34'. Because the vanes 70 are streamlined, they reduce the pressure drop across slots 34' and, therefore, reduce the work required by fan 64. The divergence of sidewalls 30' and 32' increases the volume of subchambers 62 away from slots 34 and, therefore, decreases the velocity of the air streams. Although this embodiment shows fan 64 which pushes air through slots 34', it is to be understood that fan 24 could be replaced by a fan (designated by broken lines at 66) positioned above mixing chamber 22 which sucks or draws air upwardly through slots 34. This embodiment is particularly advantageous for large applications because it can be constructed of many side by side subchambers 62** with each region being as long as desired to evaporate large quantities of water.

Although the preferred embodiments are shown and described as a humidifier, it is to be understood that this invention for evaporating a gas in a liquid could also be employed for a cooling tower, scrubber, or the like.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. Apparatus for evaporating a liquid in a gas comprising a mixing chamber having at least two sidewalls, constituting first and second sidewalls, diverging generally upwardly and a first slot between the bases of the sidewalls, means for introducing the liquid into the mixing chamber against at least one of the sidewalls to flow downwardly thereon to adjacent the slot, means for forcing the gas generally upwardly through the slot and into the mixing chamber in a stream to atomize the liquid adjacent the slot and propel it upwardly with at least a portion of the atomized liquid being evaporated in the gas stream, and an opening for discharging the gas and evaporated liquid from the mixing chamber, the divergence of the sidewalls decreasing the velocity of the stream before it is discharged from the chamber to cause unevaporated liquid to fall out of the stream.

2. Apparatus as set forth in claim 1 further comprising means for draining excess liquid from adjacent the slot to prevent the liquid from accumulating adjacent to and blocking the slot.

3. Apparatus as set forth in claim 1 further comprising a grid positioned generally above the diverging sidewalls for capturing unevaporated liquid from the gas stream.

4. Apparatus as set forth in claim 1 wherein the slot has an annular shape and wherein the first sidewall is of funnel-shape to extend upwardly and outwardly with respect to the slot.

5. Apparatus as set forth in claim 4 wherein the second sidewall has a generally frusto-conical shape tapering upwardly with respect to the slot and being generally concentric with and disposed radially inwardly of the slot.

6. Apparatus as set forth in claim 5 further comprising means for draining excess liquid from adjacent the slot to prevent the liquid from accumulating adjacent to and blocking the slot.

7. Apparatus as set forth in claim 6 further comprising a grid positioned generally above the diverging sidewalls for capturing unevaporated liquid from the gas stream.

8. Apparatus as set forth in claim 5 wherein the sidewalls are coated with a non-wetable material.

9. Apparatus as set forth in claim 8 wherein the non-wetable material is Teflon®.

10. Apparatus as set forth in claim 1 wherein said slot comprises a first elongate slot.

11. Apparatus as set forth in claim 10 wherein the mixing chamber further comprises a second elongate slot disposed adjacent to and parallel with the first slot, third and fourth sidewalls diverging generally upwardly from the second slot, means for introducing the liquid into the mixing chamber against at least one of the third and fourth sidewalls to flow downwardly thereon to a space adjacent the second slot, means for forcing a gas generally upwardly through the second slot and into the mixing chamber in a stream to atomize the liquid adjacent the second slot and propel it upwardly with at least a portion of the atomized liquid being evaporated in the gas stream.

12. Apparatus as set forth in claim 11 further comprising means for draining excess liquid from adjacent the first and second slots to prevent the liquid from accumulating adjacent to and blocking the slots.

13. Apparatus as set forth in claim 12 further comprising a grid positioned generally above the diverging sidewalls for capturing unevaporated liquid from the gas stream.

14. Apparatus as set forth in claim 11 wherein the sidewalls are coated with a non-wetable material.

15. Apparatus as set forth in claim 14 wherein the non-wetable material is Teflon®.

16. Apparatus as set forth in claim 10 wherein the mixing chamber further comprises a plurality of additional elongate slots being parallel to the first elongate slot and disposed side by side with respect to one another, a pair of sidewalls for each additional slot with each of said pairs diverging generally upwardly from its respective slot, means for introducing the liquid into the mixing chamber against at least one of the sidewalls of each of said pairs to flow downwardly thereon to spaces adjacent the slots, and means for forcing a gas generally upwardly through the slots and into the mixing chamber in streams to atomize the liquid adjacent the slots and propel it upwardly with at least a portion of the atomized liquid being evaporated in the gas streams.

17. Apparatus as set forth in claim 10 further comprising converging vanes disposed adjacent to the first elongate slot for directing the gas through the slot.

* * * * *